United States Patent [19]

Calton

[11] Patent Number: 4,673,117

[45] Date of Patent: Jun. 16, 1987

[54] BACKPACK COOLER CONSTRUCTION

[76] Inventor: James D. Calton, 511 Amigos Rd., Ramona, Calif. 92065

[21] Appl. No.: 825,445

[22] Filed: Feb. 3, 1986

[51] Int. Cl.[4] ..... A45F 4/00

[52] U.S. Cl. ..... 224/151; 224/153; 224/259; 220/3.1

[58] Field of Search ..... 224/259, 260, 153, 151, 224/148, 209, 210, 261; 150/52 R; 220/23.83, 23.86, 3.1, 403, 404

[56] References Cited

U.S. PATENT DOCUMENTS 3,902,640 9/1975 Geiben ..... 224/153
4,513,895 4/1985 Leslie ..... 224/151

FOREIGN PATENT DOCUMENTS 2155168 9/1985 United Kingdom ..... 224/153

*Primary Examiner*—Stephen Marcus
*Assistant Examiner*—David Voorhees
*Attorney, Agent, or Firm*—Ralph S. Branscomb

[57] ABSTRACT

A backpack cooler utilizes an insulated foam core that is covered on the outside with a cloth sheath and has a rigid reinforcing liner which defines a well to hold two stacked six packs of 12 ounce containers. The cloth jacket is retained to the rest of the cooler body by means of a retainer cord that fits into a peripheral retainer groove defined in the foam core, and a pair of shoulder straps fasten to the cloth jacket by means of a lateral pin that engages in a looped channel defined in the upper edge of the cloth jacket. The pin lies in a cavity defined in the foam core of the cooler body adjacent the retainer groove to prevent axial migration of the pin.

The entire structure is strong enough to support the weight of a person, so that it doubles as a seat. Also, whereas the primary thrust of the invention is the accommodation of six packs of beer or sodas in twelve ounce cans, there is also an uninsulated accessory pouch defined by the jacket of the preferred embodiment to carry miscellaneous items.

6 Claims, 5 Drawing Figures

FIG. 1
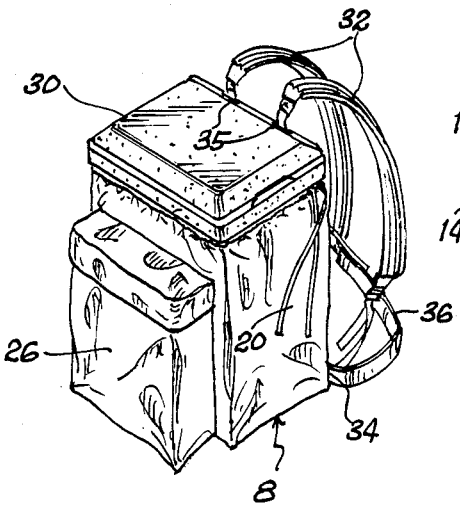
FIG. 2
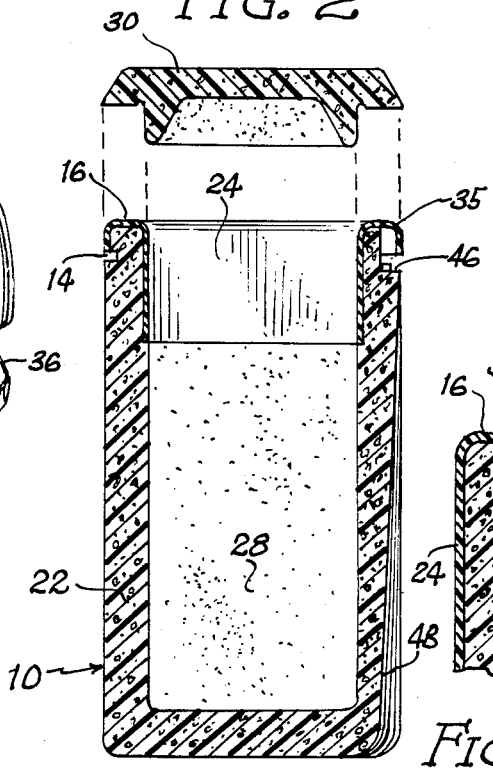
FIG. 3
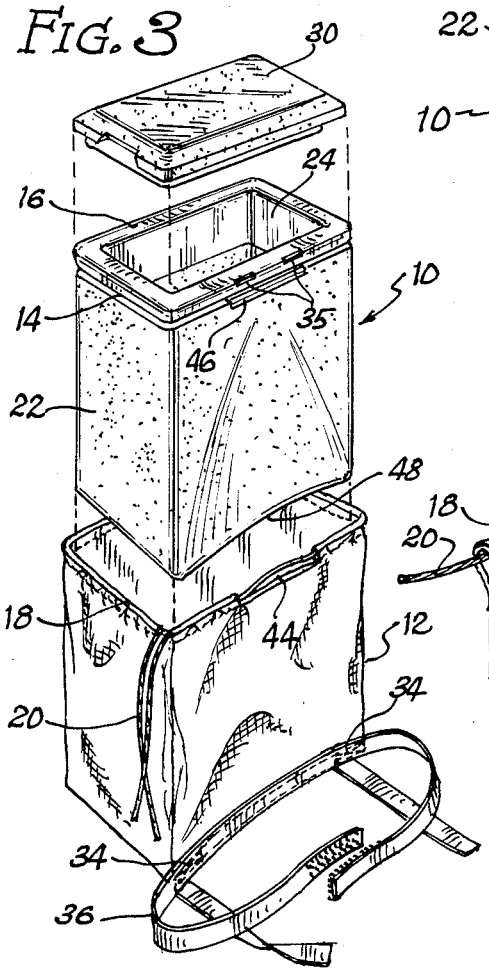
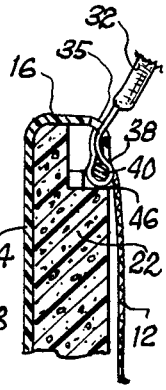
FIG. 4
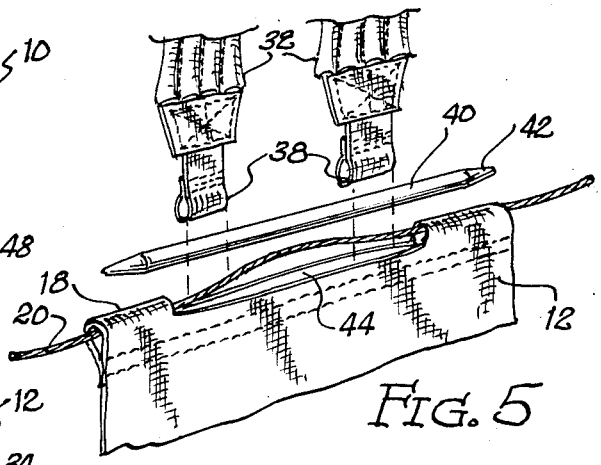
FIG. 5

BACKPACK COOLER CONSTRUCTION

BACKGROUND OF THE INVENTION

Outings of various types are among the most universal off-hour pursuits of Americans and those of means in other parts of the world. Outings can be of the rugged type, climbing a mountain trail or a desert day hike, or of the more common, civilized and urban type such as a day at the beach or park, or a night at a concert in a sports arena or in the open air.

One thing that such outings have in common, and which pertains to the instant invention, is the fact that they are away from the individual's or family's car and require the transport of certain paraphernalia on foot. A beach outing is a typical example, and a good example, because of the relatively great amount of "stuff" that must be carried from the car to the beach on foot. For a typical family with two adults and a little kid or two, the supplies and equipment would generally include at least two folding chairs, towels, surf toys, plastic sand buckets and shovels, snack foods and lots of cold beverages.

The cold beverages are the most compact and weighty of the supplies, and must be kept cold, so typically a large cooler is found among the paraphernalia. If it is the type of cooler that has two handles, whoever carries it can carry little else, and may well have a hernia by the time he gets to the beach and have to leave early for medical help. The newer suitcase-type coolers are somewhat easier to carry, requiring, as they do, the use of only one hand. Nevertheless, carrying one or more of this type of cooler several blocks to the beach, in conjunction with all of the other equipment, is a prospect that casts a pall over the otherwise bright prospect of going to the beach or on a similar outing.

There is a need for a carrying container that takes advantage of the generally standardized size and shape of cold beverage containers in order to make them more easily transportable on outings. Because the favorite kind of beverage, at least in this country, is either soda pop or beer sold in a 12-ounce can, beverage supplies are thus more or less standard and capable of being accomodated by means of a carrier specifically designed to accomodate these cans and keep them cold. Beverages are generally only one of numerous supply items needed on an outing. They are often the heaviest and the densest, and the requirement that they be kept cool often makes them bulky and awkward, so that a beverage carrying container that would in essence eliminate all beverage carrying problems would be a major asset to picnikers and the like.

SUMMARY OF THE INVENTION

The instant invention provides such an assist to picnickers in the form of a specially designed backpack that does not treat the conveying of beverages as secondary or ancilliary to the transport of other equipment and supplies, but in fact focusses directly on that heart of modern off-hour entertainment, the cold beverage.

The backpack comprises a foam core which has a front face that is contoured to comfortably fit the back of a user, and the inside of the core is dimensioned to hold two stacked six packs of beer or soda. A tight-fitting lid prevents loss of cold air by convection.

The inside of the core is lined with high-density plastic, and around the outside of the core is a fabric jacket, which is important to the invention. The cloth jacket yields great flexibility in the addition of pockets and holders for various accessories, and also acts as a structural hub for joining the shoulder straps and the body of the cooler sufficiently securely and durably to endure the hiking and rough handling that the unit will inevitably experience during its life.

BRIEF DESCRIPTION OF THE DRAWINGS

FIG. 1 is a perspective view of the invention;

FIG. 2 is a vertical section taken centrally through the invention front-to-rear;

FIG. 3 is an exploded perspective view of the body and lid of the backpack cooler;

FIG. 4 is an exploded view of details of the cloth jacket retainer construction; and, FIG. 5 is a perspective view of a detail of the cooler illustrating the interrengagement of the straps, the pin and the peripheral loop in the upper edge of the jacket.

DETAILED DESCRIPTION OF THE PREFERRED EMBODIMENT

The overall construction of the backpack cooler of the instant invention can best be understood by reference to the exploded perspective view of FIG. 3, in which the body 8 of the cooler is shown in two of its separate components, the insert 10 and the cloth jacket 12 which is cut and sewn to closely fit the insert, so that there is relatively little migration of the fabric of the jacked across the face of the insert in use. The insert has a continuous peripheral groove 14 just below the rim 16, and the upper edge of the cloth jacket is sewn to define a generally continuous hemmed loop 18 which sheathes the retainer cord 20. The retainer cord is cinched down into the groove 14 to retain the cloth jacket to the insert 10. The cord could be substantially inelastic and tied, or it could be elastic and dimensioned to snap into the retainer groove of the insert.

The insert 10 comprises a foam core 22 which may have a reinforcing liner 24 which laps around top of the foam core to define the upper rim 16 of the insert. The liner greatly strengthens the groove area of the foam core, and the looped portion of the jacket which sheathes the retainer cord bears directly against this member when the backpack is carried. The liner, which would be composed of ABS plastic or some other high density smooth plastic, is shown as extending down only partially into the insert. As an alternative, the liner could completely cover the inside of the foam core. In either case, the core is foamed inside the pre-formed liner and bonds to it securely without any additional adhesive.

Although it is at the heart of the invention that the beverages be conveniently bourne on the back to free the hands, other items as well can be conveniently stored in the backpack. To this end, an exemplary pouch 26, with a Velcro cover or the like, is shown in FIG. 1. Other arrangements of pockets or pouches could be used to accomodate various special items.

The inner well 28 defined by the body 8, best shown in FIG. 2, is dimensioned in the preferred embodiment to hold two six packs stacked one on top of the other. A shorter well for a single six pack, or for other than six cans, could be provided, but the 12 can configuration is a good size for backpack and accomodates a good outing with several people. Obviously, if 12 cans are not needed, the remaining space can be used to carry other accessories and supplies. A tight-fitting lid 30 remains in position by virtue of its tight fit, and is preferably adequately strong to support the weight of a seated adult. In the preferred embodiment, the lid is made of the same 3-pound density insullating foam from which the core 22 is made.

Two adjustable shoulder straps 32 are sewn to the bottom of the jacket as indicated at 34 and pass through the slots 35 in the liner. A waist strap 36 may also be used. However, the weight of the backpack is supported by the upper ends of the shoulder straps which define loops 38 through which passes retainer pin 40. This pin has tapered ends 42 which insert into the open portions of the continuous loop 18 at the top of the jacket. A cutaway portion 44 is defined in the upper front edge of the jacket so that the pin can slip in as shown in FIG. 4. The pin could be hollow and pass the retainer cord through its length, in which case the pn could fit in the retainer groove 14.

A housing cavity 46 is milled or otherwise provided in the ront face of the foam core to capture the pin, and prevent its axial migration, so that once the straps 32 are engaged on the pin, and the pin seats in the housing cavity 46, there is no possibility of accidental dislodgement of the straps.

As shown in FIG. 2, the front face of the foam core is sculptured somewhat, rather than being entirely flat, such that the lower portion is forwardly concave at 48 to accomodate the back of one carrying the backpack. The lower contour increasingly flattens out toward the top and finally becomes straight across as shown, at the upper edge. The liner 24 does not need to take the contour of the front face of the foam core into account and is not contoured.

Although many different styles of backpacks have been provided, and there are numerous varied styles of cooler, the instant invention goes right to the heart of the recreational supply transporting business and provides means for transporting ice-cold beer and pop to the outing party site so easily and conveniently that it would be hard to imagine the old days of the two-handled cooler, the back strain, and the aggravation.

I claim:

1. A backpack cooler construction comprising:

(a) an open-topped insulated body defining a well for containing cold beverages while keeping them cold;

(b) an insulated lid for covering the top of said body and maintaining said well substantially sealed from outside air;

(c) said body having a rigid insert and a cloth jacket substantially covering said insert;

(d) a pair of shoulder straps connected to said body and enabling a person to strap said body on his back for transport;

(e) said rigid insert having an upper rim and an external circumferential retaining groove adjacent said rim; and, (f) said jacket defining an upper peripheral loop enclosing a retainer cord for engaging in said groove for retaining said jacket on said body.

2. Structure according to claim 1 wherein said loop has a cutaway portion at a position central to the upper front face of said body, and including a pin spanning said cutaway portion and engaging in said loop at the opposite ends of said cutaway portion so that a central portion of said pin is exposed through said cutaway portion, and said shoulder straps engage said pin by the central portion of said pin.

3. Structure according to claim 2 wherein said insert defines a pin housing cavity adjacent said retaining groove for locating said pin for preventing the axial migration of same.

4. Structure according to claim 3 wherein said jacket is sufficiently accurately contoured to to fit said insert closely enough to prevent the relative migration therebetween, such that the cutaway portion of said loop does not migrate relative to said pin to permit the escape of the latter from said loop.

5. Structure according to claim 2 wherein said pin is hollow and said retainer cord passes therethrough.

6. Structure according to claim 2 wherein said jacket mounts at least one externally accessible accessory compartment.

* * * * *